United States Patent [19]

Hara

[11] Patent Number: 4,558,677

[45] Date of Patent: Dec. 17, 1985

[54] AIR-FUEL RATIO CONTROL SYSTEM

[75] Inventor: Kazuo Hara, Musashino, Japan

[73] Assignee: Fuji Jukogyo Kabushiki Kaisha, Tokyo, Japan

[21] Appl. No.: 637,673

[22] Filed: Aug. 3, 1984

[30] Foreign Application Priority Data

Aug. 11, 1983 [JP] Japan ..... 58-146864

[51] Int. Cl.[4] ..... F02M 7/12

[52] U.S. Cl. ..... 123/440

[58] Field of Search ..... 123/440, 489, 589; 60/276

[56] References Cited

U.S. PATENT DOCUMENTS

| | | | |
|---|---|---|---|
| 3,782,347 | 1/1974 | Schmidt et al. | 123/489 |
| 4,029,061 | 6/1977 | Asano | 123/440 |
| 4,153,022 | 5/1979 | Asano et al. | 123/440 |
| 4,156,412 | 5/1979 | Kraus | 123/440 |
| 4,173,952 | 11/1979 | Asano | 123/440 |
| 4,290,400 | 9/1981 | Pomerantz | 123/440 |
| 4,300,505 | 11/1981 | Takada et al. | 123/489 |
| 4,365,603 | 12/1982 | Shikata et al. | 123/440 |

FOREIGN PATENT DOCUMENTS 51-124738 10/1976 Japan .

*Primary Examiner*—Andrew M. Dolinar
*Attorney, Agent, or Firm*—Martin A. Farber

[57] ABSTRACT

An air-fuel control system for an engine mounted on a vehicle comprises an $O_2$ sensor, a feedback control system including a proportion and integration control circuit having resistors as proportion and integration constant elements, and switches for changing the resistors. An air-fuel ratio deviation detecting circuit is provided to respond to the output of the $O_2$ sensor for producing an output signal when the air-fuel ratio greatly deviates from the stoichiometric air-fuel ratio at rapid acceleration or deceleration of the vehicle. The output signal is applied to the switches to operate it so as to increase the proportion and integration constant.

4 Claims, 4 Drawing Figures

AIR-FUEL RATIO CONTROL SYSTEM

BACKGROUND OF THE INVENTION

The present invention relates to an air-fuel ratio control system for an internal combustion engine mounted on a vehicle, which controls the air-fuel ratio of an air-fuel mixture to an approximate stoichiometric air-fuel ratio value at which a three-way catalyst acts most effectively.

In a conventional air-fuel ratio control system, the air-fuel ratio of the air-fuel mixture burned in cylinders of the engine is detected as oxygen concentration in exhaust gases by means of an $O_2$ sensor provided in an exhaust system of the engine, and a decision is made from the output signal from the $O_2$ sensor whether the air-fuel ratio is richer or leaner than the value corresponding to the stoichiometric air-fuel ratio for producing a control signal. The control signal is applied to a proportion and integration circuit (PI circuit), the output of which is changed to pulses. The pulses operate an electromagnetic valve for controlling the air-fuel ratio of the mixture. Thus, the air-fuel ratio is controlled to the stoichiometric air-fuel ratio at which the three-way catalyst acts most effectively. In such an air-fuel ratio control system, when the vehicle is accelerated or decelerated the air-fuel ratio is subject to deviate from the stoichiometric air-fuel ratio. Japanese patent application laid open No. 51-124738 discloses an air-fuel ratio control system which is provided with detecting means for detecting transient conditions such as rapid acceleration and deceleration and for correcting a feedback control signal so as to make the deviated air-fuel ratio converge to the stoichiometric air-fuel ratio. The detecting means comprises a throttle position sensor or an intake manifold vacuum sensor. Such a system of the prior art has a disadvantage that feedback operation is delayed when the air-fuel ratio greatly deviates at transient.

SUMMARY OF THE INVENTION

The object of the present invention is to provide an air-fuel ratio control system which is not provided with a mechanical transient detecting device such as a throttle position sensor or a vacuum sensor, but with novel electrical detecting means whereby the deviation of the air-fuel ratio can be quickly converge to a proper value in accordance with transient conditions.

To this end, according to the present invention, there is provided an air-fuel ratio control system for a vehicle powered by an internal combustion engine having an induction passage, air-fuel mixture supply means, an electromagnetic valve for correcting the air-fuel ratio of the air-fuel mixture supplied by the means, an $O_2$ sensor for detecting oxygen concentration in exhaust gases, a first comparator for comparing the output of the $O_2$ sensor with a reference value and for producing an output signal relative to the comparison, and a feedback control circuit responsive to the output of the comparator for producing a control output signal for driving the electromagnetic valve for correcting the air-fuel ratio.

The system comprises an air-fuel ratio deviation detecting circuit responsive to the output signal of the first comparator for producing an output signal when the output signal of the comparator exceeds a predetermined condition at a transient state of the drive of the vehicle; and means responsive to the output signal of the air-fuel ratio deviation detecting circuit for changing circuit constants of the feedback control circuit so as to expedite the operation of the feedback control circuit.

The other objects and features are explained more in detail with reference to the accompanying drawings.

DETAILED DESCRIPTION OF THE PREFERRED EMBODIMENTS

Figure 1:
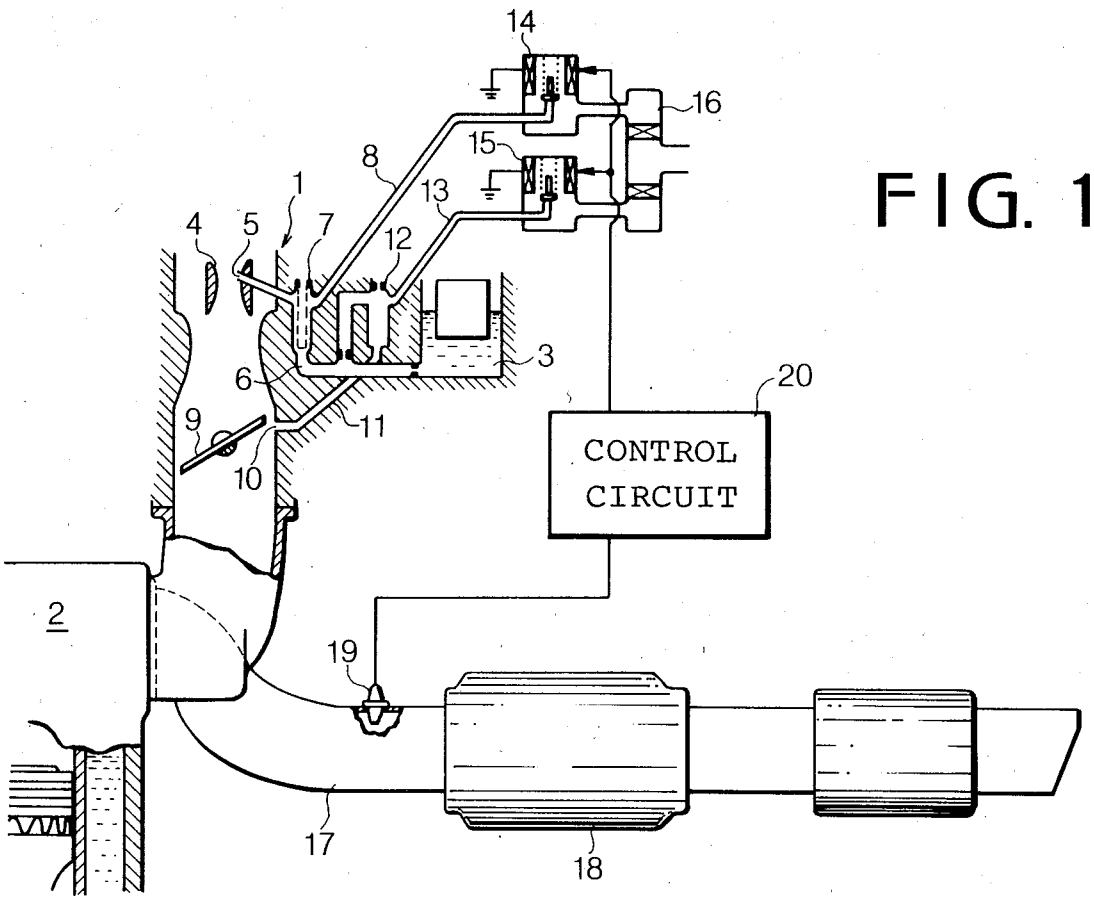
FIG. 1 is a schematic explanatory view of an air-fuel ratio control system according to the present invention.

Referring to FIG. 1 showing schematically an air-fuel ratio control system of the present invention, the reference numeral 1 designates a carburetor provided upstream of an engine 2. A correcting air passage 8 is communicated with an air-bleed 7 which is provided in a main fuel passage 6 between a float chamber 3 and a nozzle 5 in a venturi 4. Another correcting air passage 13 communicates with another air-bleed 12 which is provided in a slow fuel passage 11 which diverges from the main fuel passage 6 and extends to a slow port 10 opening in the vicinity of a throttle valve 9. These correcting air passages 8 and 13 are communicated with on-off type electromagnetic valves 14, 15, induction sides of which are communicated with the atmosphere through an air cleaner 16. Further, a three-way catalytic converter 18 is provided in an exhaust pipe 17 downstream of the engine, and an $O_2$ sensor 19 is provided between the engine 2 and the converter 18 to detect the oxygen concentration of the exhaust gases as the air-fuel ratio of the mixture burned in the cylinder of the engine.

An output signal from the $O_2$ sensor 19 is sent to a control circuit 20 which produces an output signal to actuate electromagnetic valve 14, 15 to open and close at a duty ratio. Thus, a great deal of air is supplied to the fuel system through correcting air passages 8, 13 to produce a lean air-fuel mixture or a small amount of air is supplied to enrich the air-fuel mixture.

Figure 2:
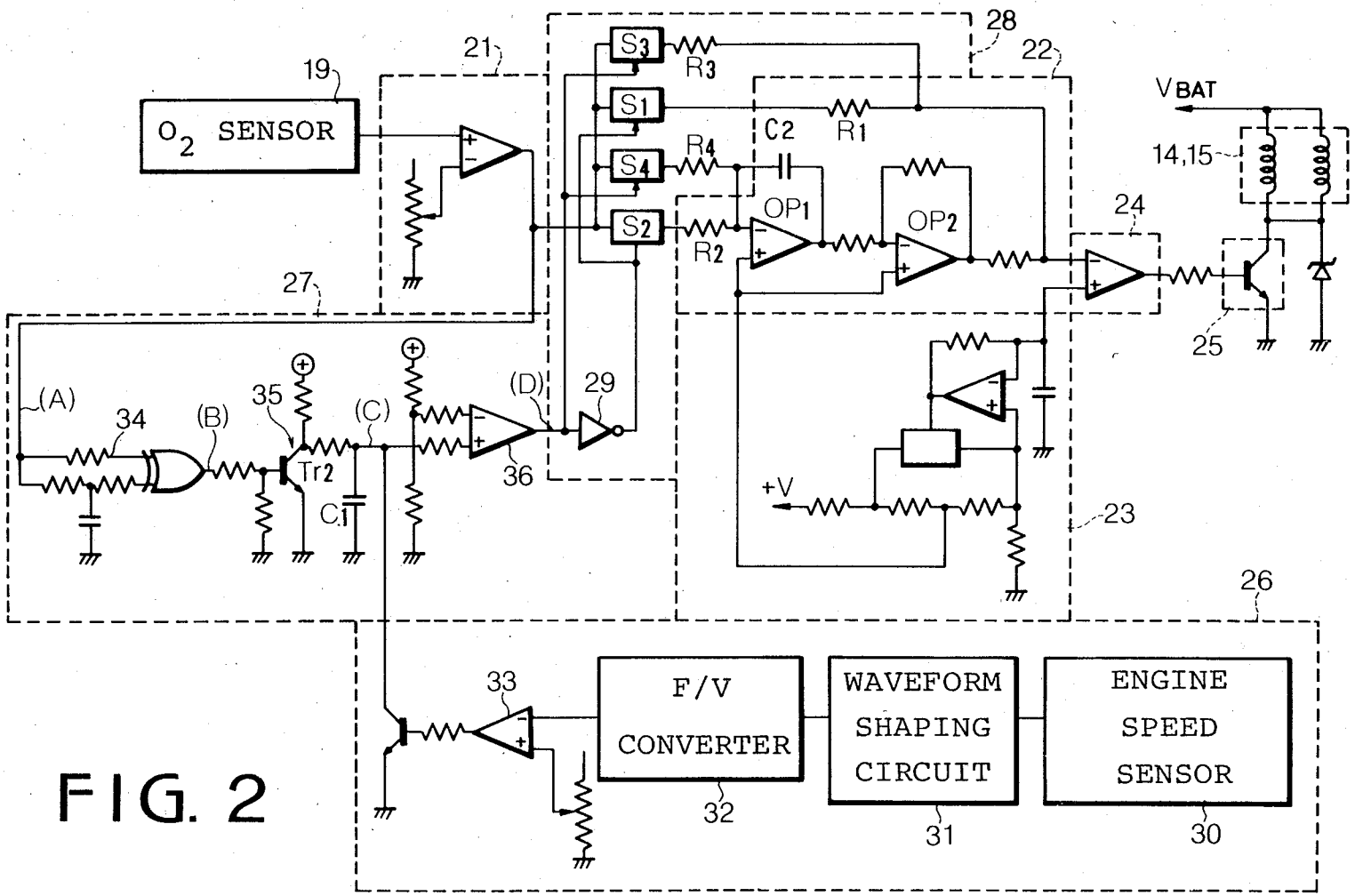
FIG. 2 is an electric circuit of the present invention.

FIG. 2 shows a construction of the control circuit 20 including the $O_2$ sensor and the electromagnetic valves 14, 15. Outputs of the $O_2$ sensor 19 are applied to a PI (proportion and integration) control circuit 22 through a comparator 21 and analogue switches $S_1$ and $S_2$. The output of the PI control circuit 22 is applied to another comparator 24. The comparator 24 compares the output of the PI control circuit 22 with triangular wave pulses from a triangular wave pulse generator 23 and produces square wave pulses as a result of the comparison. The square wave pulses are fed to the electromagnetic valves 14, 15 via a driver 25 for operating the valves.

In the system of the present invention, a driving condition detecting circuit 26 and an air-fuel ratio deviation detecting circuit 27, a constants changing circuit 28 are provided in order to change constants of the PI control circuit 22. The PI control circuit 22 comprises an integrator $OP_1$, amplifier $OP_2$, capacitor $C_2$ resisters $R_1$ and $R_3$ as proportion constant elements, and resisters $R_2$ and $R_4$ as integration constant elements. These resistors are connected in parallel and connected to the output terminal of the comparator 21 through analog switches $S_1$–$S_4$, respectively.

The driving condition detecting circuit 26 comprises an engine speed sensor 30 which produces pulses dependent on ignition pulses of the engine, a waveform shaping circuit 31, a frequency-to-voltage (F/V) converter 32, and a comparator 33. The comparator 33 compares the output of the F/V converter 32 with a reference value and produces a high level output when the engine speed is lower than a predetermined value, for example 1500 rpm. The high level output turns on a transistor $Tr_1$ to ground a part of the detecting circuit 27 so as to disable it.

The air-fuel ratio deviation detecting circuit 27 comprises a monostable multivibrator 34 comprising an exclusive OR gate, which operates to produce a one-shot pulse in response to either high and low outputs of comparator 21. The circuit 27 further comprises a hold circuit 35 comprising a transistor $Tr_2$ and a capacitor $C_1$, and a comparator 36.

In operation, when the engine speed is lower than the predetermined speed (1500 rpm), this means that the engine is in idling operation, the comparator 33 produces a high level output signal, causing the transistor $Tr_1$ to turn on. Accordingly, a point (C) in the detecting circuit 27 is grounded, so that the output signal of the comparator 36 is at a low level. The low level output signal is applied to control gates of analog switches $S_3$ and $S_4$ to open them, and the output signal is inverted to a high level signal by an inverter 29. The high level signal is applied to control gates of analog switches $S_1$ and $S_2$ to turm them on.

Generally, the air-fuel ratio varies cyclically with respect to the stoichiometric air-fuel ratio. Accordingly, the output of the $O_2$ sensor 19 has a waveform having a constant wavelength. The output is compared with a reference value at the comparator 21 which produces pulses dependent on the waveform as shown in FIG. 3(A). The pulses are applied to the PI control circuit 22 through resistor $R_2$, so that the PI control circuit produces an output signal having a waveform as shown during a period $t_1$ of FIG. 4. The output signal is converted to pulses by the comparator 24 for operating the electromagnetic valves 14, 15 as described above.

When the engine speed exceeds the predetermined value, the output of the comparator 33 goes to a low level, causing the transistor $Tr_1$ to turn off. Thus the air-fuel ratio deviation detecting circuit 27 becomes operative. When the deviation of the air-fuel ratio from the stoichiometric air-fuel ratio is comparatively small, the pulse spacing of the pulses of FIG. 3(A) is small. The monostable multivibrator 34 produces pulses (B) in response to a positive going voltage and negative going voltage of the pulses (A). Each pulse (B) turns on the transistor $Tr_2$, causing the capacitor $C_1$ to discharge. Since the pulse spacing of the pulses (B) is small, the charged voltage at a point (C) is lower than a reference voltage Vo as shown in FIG. 3(C). Accordingly, the output signal of the comparator 36 is at a low level. Thus, the above described feedback operation is carried out at a small proportion constant by the resistor $R_1$ and a small integration constant by the resistor $R_2$. The proportion and integration constants are selected to properly control the air-fuel ratio during the steady state of driving condition.

Figure 3:
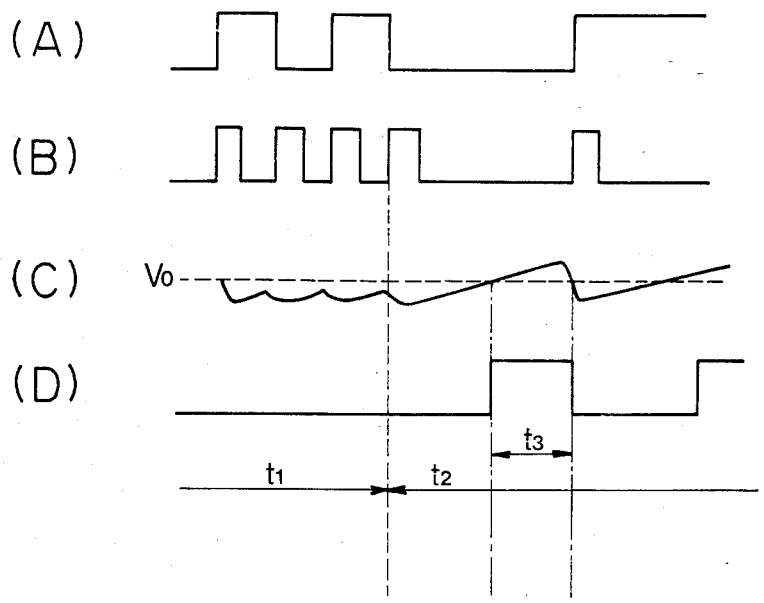
FIG. 3 shows waveforms at positions in the circuit of FIG. 2.
Figure 4:
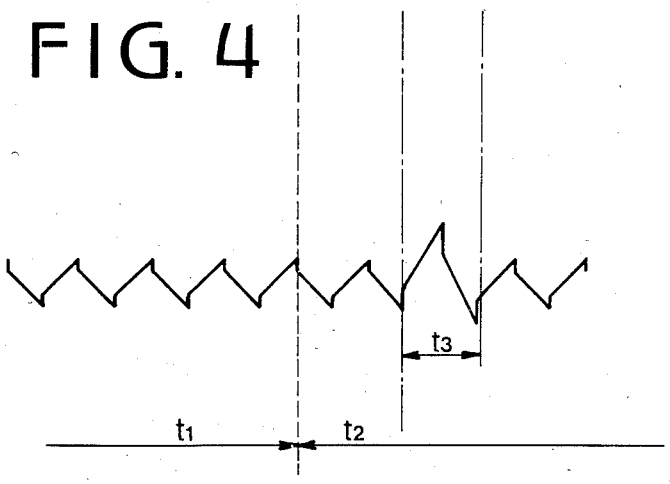
FIG. 4 shows a waveform of output of a PI circuit.

When the air-fuel ratio greatly deviates from the stoichiometry at rapid acceleration or deceleration, the pulse width of pulse (A) from the comparator 21 becomes large as shown during period $t_2$ in FIG. 3. Accordingly, the pulse spacing of the pulses (B) becomes large, so that voltage (C) exceeds the reference voltage $V_o$. Thus, the output signal of the comparator 36 goes to a high level signal which causes switches $S_3$ and $S_4$ to turn on and switches $S_1$ and $S_2$ to turn off. By resistors $R_3$ and $R_4$, constants of the PI control circuit become large, so that PI control circuit 22 produces a steeply varying output as shown during period $t_3$ in FIG. 4. Thus, the deviation of the air-fuel mixture can be quickly controlled to the stoichiometry.

Although the above described embodiment of the present invention comprises analog circuit elements, a microcomputer system can be used in the system of the present invention. Further, the system can be used for an engine having a fuel injection system.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. An improved air-fuel ratio control system for a vehicle powered by an internal combustion engine having an induction passage, air-fuel mixture supply means, an electromagnetic valve for correcting the air-fuel ratio of the air-fuel mixture supplied by said means, an $O_2$ sensor for detecting oxygen concentration in exhaust gases, a first conparator for comparing the output of said $O_2$ sensor with a reference value and for producing an output signal relative to the comparison, and a feedback control circuit responsive to the output of said comparator for producing a control output signal for driving said electromagnetic valve for correcting the air-fuel ratio; wherein the improvement comprises means comprising an air-fuel ratio deviation detecting circuit responsive to the output signal of said first comparator for producing an output signal when the output signal of said comparator exceeds a predetermined condition at a transient state of the driving of said vehicle;

means responsive to said output signal of said air-fuel ratio deviation detecting circuit for changing circuit constants of said feedback control circuit so as to expedite the operation of the feedback control circuit, a driving condition detecting circuit for disabling said air-fuel ratio deviation detecting circuit at a predetermined driving condition, said driving condition detecting circuit comprises a circuit responsive to ignition pulses of the engine for producing an engine speed signal, first comparator means for producing an engine low speed when the engine speed signal is lower than a predetermined value, and means responsive to said engine low speed signal for disabling said air-fuel ratio deviation detecting circuit.

2. The system as set forth in claim 1, wherein said air-fuel ratio deviation detecting circuit comprises a monostable multivibrator operatively responsive to the output of the $O_2$ sensor for producing pulses, a capacitor operatively connected to a voltage source for charging the capacitor, switch means responsive to the output of said monostable multivibrator for discharging the capacitor, and second comparator means for comparing charged voltage in the capacitor with a reference value and for producing an output signal, constituting the output signal of said air-fuel ratio deviation detecting circuit, when the charged voltage is higher than a reference voltage.

3. The air-fuel ratio control system as set forth in claim 2, wherein said feedback control circuit includes a proportion and integration control circuit including elements providing proportion constants and integration constants constituting said circuit constants, said means responsive to said output signal of said air-fuel ratio deviation detecting circuit comprises switch means responsive to said output signal of said second comparator means for operatively changing selective of the elements so as to increase the constants.

4. The system as set forth in claim 1, wherein said predetermined driving condition is idling operation of the engine, and said feedback control circuit with predetermined circuit constants thereof drives said electromagnetic valve when said air-fuel ratio deviation detecting circuit is disabled.

* * * * *